US006635197B2

(12) United States Patent
Cortum et al.

(10) Patent No.: US 6,635,197 B2
(45) Date of Patent: Oct. 21, 2003

(54) METHOD AND APPARATUS FOR CASTING MOLTEN MATERIALS USING PHASE-CHANGE MATERIAL

(75) Inventors: John David Cortum, Mediapolis, IA (US); Michael Jaye Mathiasmeier, Mediapolis, IA (US); Louis William Stoecker, Burlington, IA (US)

(73) Assignee: American Ordinance LLC, Middletown, IA (US)

( * ) Notice: Subject to any disclaimer, the term of this patent is extended or adjusted under 35 U.S.C. 154(b) by 0 days.

(21) Appl. No.: 09/891,117

(22) Filed: Jun. 25, 2001

(65) Prior Publication Data

US 2002/0195733 A1 Dec. 26, 2002

(51) Int. Cl.[7] ..... B29C 31/06; C06B 21/00

(52) U.S. Cl. ..... 264/3.1; 86/20.12; 425/549; 425/551; 425/DIG. 245; 264/259

(58) Field of Search ..... 264/3.1, 259; 86/1.1, 86/20.12; 425/86, 110, 549, 551, DIG. 245, 586

(56) References Cited

U.S. PATENT DOCUMENTS

| | | | | | |
|---|---|---|---|---|---|
| 1,899,095 | A | * | 2/1933 | Knight et al. | 86/20.12 |
| 3,516,801 | A | * | 6/1970 | Shah | 422/104 |
| 3,967,527 | A | * | 7/1976 | Dunn et al. | 264/3.1 |
| 4,174,043 | A | * | 11/1979 | Salame et al. | 264/456 |
| 4,336,209 | A | * | 6/1982 | Gylden et al. | 264/3.1 |
| 4,380,186 | A | * | 4/1983 | Buhrer | 264/3.1 |
| 4,393,014 | A | * | 7/1983 | Ziegler | 264/3.1 |
| 5,167,928 | A | * | 12/1992 | Kelly et al. | 422/99 |
| 5,269,365 | A | | 12/1993 | Lallement et al. | |
| 5,619,073 | A | * | 4/1997 | Posey et al. | 264/3.1 |
| 6,108,489 | A | * | 8/2000 | Frohlich et al. | 126/263.01 |

FOREIGN PATENT DOCUMENTS

| | | | | | |
|---|---|---|---|---|---|
| DE | 3501286 | A1 | * | 8/1985 | |
| GB | 2153053 | A | * | 8/1985 | 264/3.1 |

* cited by examiner

*Primary Examiner*—Mark Eashoo
*Assistant Examiner*—Geoffrey P. Shipsides
(74) *Attorney, Agent, or Firm*—Brian J. Laurenzo; Michael C. Gilchrist; Jason M. Hunt

(57) ABSTRACT

A method and apparatus for casting a molten material using a phase-change material. A funnel means is provided that includes a reservoir containing a phase-change material. The funnel means is used in conjunction with a mold. The phase-change material is heated to a temperature above its melting point. A molten material is poured into the mold, and an excess amount of the molten material is retained in the funnel means after the mold is filled. The latent heat of fusion of the phase-change material provides heat to the funnel means as the phase-change material changes from a liquid to a solid. The heat from the phase-change material maintains the temperature of the molten material within the funnel above its melting point as the molten material within the mold begins to solidify and contract, thereby permitting the excess material within the funnel means to feed into the mold and fill any voids or porosities formed by the contraction of the material within the mold. The funnel means may also include a neck-engaging portion in thermal contact with the phase-change material for engaging an upper, or neck, portion of the mold to maintain molten material contained within that portion above its melting temperature for an extended period of time. The apparatus and method are particularly well suited for use in casting explosive projectile shells.

3 Claims, 8 Drawing Sheets

METHOD AND APPARATUS FOR CASTING MOLTEN MATERIALS USING PHASE-CHANGE MATERIAL

TECHNICAL FIELD

The invention relates generally to method and apparatus used to cast molten materials. More specifically, the invention relates to a method and apparatus that includes a funnel insulated with a phase-change marerial used to cast explosives, especially explosive projectiles. The invention takes advantage of the latent heat of fusion of the phase-change material to maintain the funnel and projectile neck at an elevaled tempaerature during the casting and cooling process in order to keep the funnel and projectile neck open.

BACKGROUND OF THE INVENTION

A common method for manufacturing explosive projectilies involves pouring molten explosive material into a body casing. Typically, a funnel is used to help guide the molten explosive material into the projectile body. Explosives such as trnitrotoluenen (TNT) and composition B (a mixture of TNT and cyclotrimethylenetrinitramine (RDX) contract as they cool and harden into a solid. This contraction can cause gaps or porosities in the final product. These gaps are undesirable and can cause problems such as premature explosion in the gun barrel.

One strategy for avoiding the gaps is to overfill the projectile body during the initial pour of the molten explosive with the excess explosive being contained in the funnel immediately after the pour. If the explosive in the funnel is kept in a liquid state, it can feed into the projectile body, as the explosive in the projectile body hardens and contracts, thereby filling-in the gaps that otherwise form. In order to prevent the molten explosive from cooling too quickly and solidifying, it is known to insulate or heat the funnel.

If the funnel surface gets too cool, it can cause the molten material to harden and block the funnel. If the funnel surface gets too hot, that can cause problems as well. The high temperature heating surfaces present a safety hazard to users if the user skin would come in contact with the heated surface. Additionally, if the heated surface gets too hot, it can present a risk of explosion.

Funnels that are merely heavily insulated, but not provided with any source of heat, typically do not keep the funnel open for a sufficient time to prevent defects in the casting. Funnels that are provided with a heat source, such as hot water or steam oven panels typically will keep the funnel open for a sufficient period of time to allow for a complete casting. However, such methods of heating the funnels have a high initial cost and a high operating cost. If the temperature of the funnel surface is not carefully controlled, it may heat the molten explosive above the desired temperature. Another option is to preheat the funnel in an oven. The primary difficulty with this method is that the funnel must be prohibitively massive in order to retain enough heat to keep the funnel open for the required length of time. It can also be difficult to control, or even verify, the temperature of the funnel during the process when using this method. Additionally, because it is necessary to heat the funnel above the melt temperature of the explosive, this method can lead to heating the molten explosive above the desired temperature during the beginning of a pour.

An additional method of heating the funnels uses forced air. This also results in high costs because it requires the control of airflow to multiple ovens. It also requires proper ventilation to remove explosive fumes that may be carried in the heated air. Finally, the air temperature must be above the melting point of the explosive, and therefore tends to heat the molten explosive above desired temperatures.

Therefore, there exists a need for a method and apparatus that permits the casting of explosive projectiles that maintains the funnel open for a sufficient amount of time to permit a highly quality cast, but does not heat the molten explosive above desired limits. Preferably, the apparatus will not have a high initial cost or a high operation cost, will be safe to use, and will be consistent and reliable.

The present invention satisfies the above identified needs.

SUMMARY OF THE INVENTION

The present invention is directed to an insulator and funnel for use in pouring explosive projectiles. The funnel has a sloping funnel surface in thermal contact with a reservoir in the insulator. The reservoir contains a phase-change material. The phase-change material has a melting point that is higher than the melting point of the explosive material. Preferably the phase-change material is also in thermal contact with a top, or neck portion of the projectile body. The phase-change material is preheated to a temperature sufficient to melt the phase-change material. A molten explosive material is poured through the funnel into a projectile body. As the phase-change material changes from a liquid to a solid, the latent heat of fusion of the phase-change material maintains the sloping surface of the funnel and projectile neck at a near constant temperature that is warm enough to permit the molten explosive material to flow through the funnel and projectile neck for a sufficient amount of time to supply molten explosive into the projectile body as it cools, shrinks, and solidifies.

BRIEF DESCRIPTION OF THE DRAWINGS

FIG. 4A is a detail close-up view showing the seam of the two halves of the preferred embodiment of the funnel insulator of FIG. 4.

DETAILED DESCRIPTION OF THE PREFERRED EMBODIMENT

Figure 1:
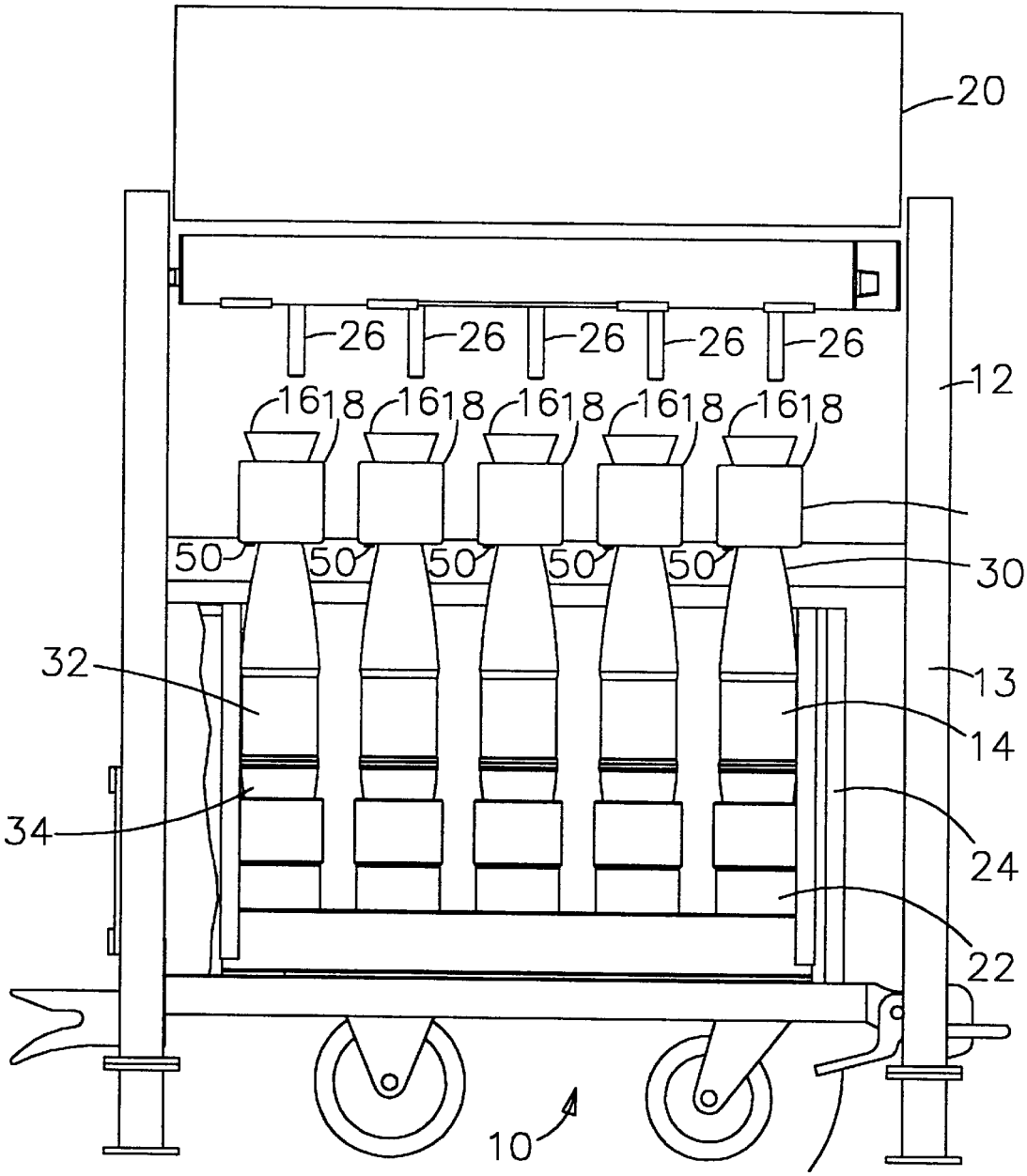
FIG. 1 is a partial cut-away front view of a cart used to cast explosive projectiles with phase-change funnels in place on the projectile bodies.

Shown generally in FIG. 1 is an arrangement used to manufacture explosive projectile bodies according to the present invention. More specifically, FIG. 1 shows a cart 10 in operational position beneath a loading machine 12. The loading machine 12 includes a pair of uprights 13 that support a manifold 20 which contains molten explosive material. Included on the cart 10 is a rack 22, which holds projectile bodies 14 in an upright position. Each projectile body 14 can be divided into three general sections: A neck 30 at the top of the body, a body 32 in the middle, and a base 34 at the bottom. The bases 34 of the projectile bodies 14 are placed within the rack 22. Funnel insulators 18 rest on the necks 30 of the projectile bodies 14, and extend above the top of the necks 30. Funnels 16 are fitted within the funnel insulators 18, and extend downwardly into the neck 30 of the projectile bodies 14. The loading machine 12 has pouring spouts 26 aligned above corresponding funnels 16. The spouts 26 are in flowable connection with the manifold 20 such that molten explosive material can flow from the manifold 20 through the spouts 26 and into the funnels 16. A latch 28 is provided on the cart 10 to allow multiple carts to be locked together. The cart 10 shown in FIGS. 1 and 2 includes walls 24 that form a tank 25 that can be used to hold cooling water; however, in the preferred embodiment air is used to cool the projectile bodies 14, and the tank 25 is not included on the cart 10.

Figure 2:
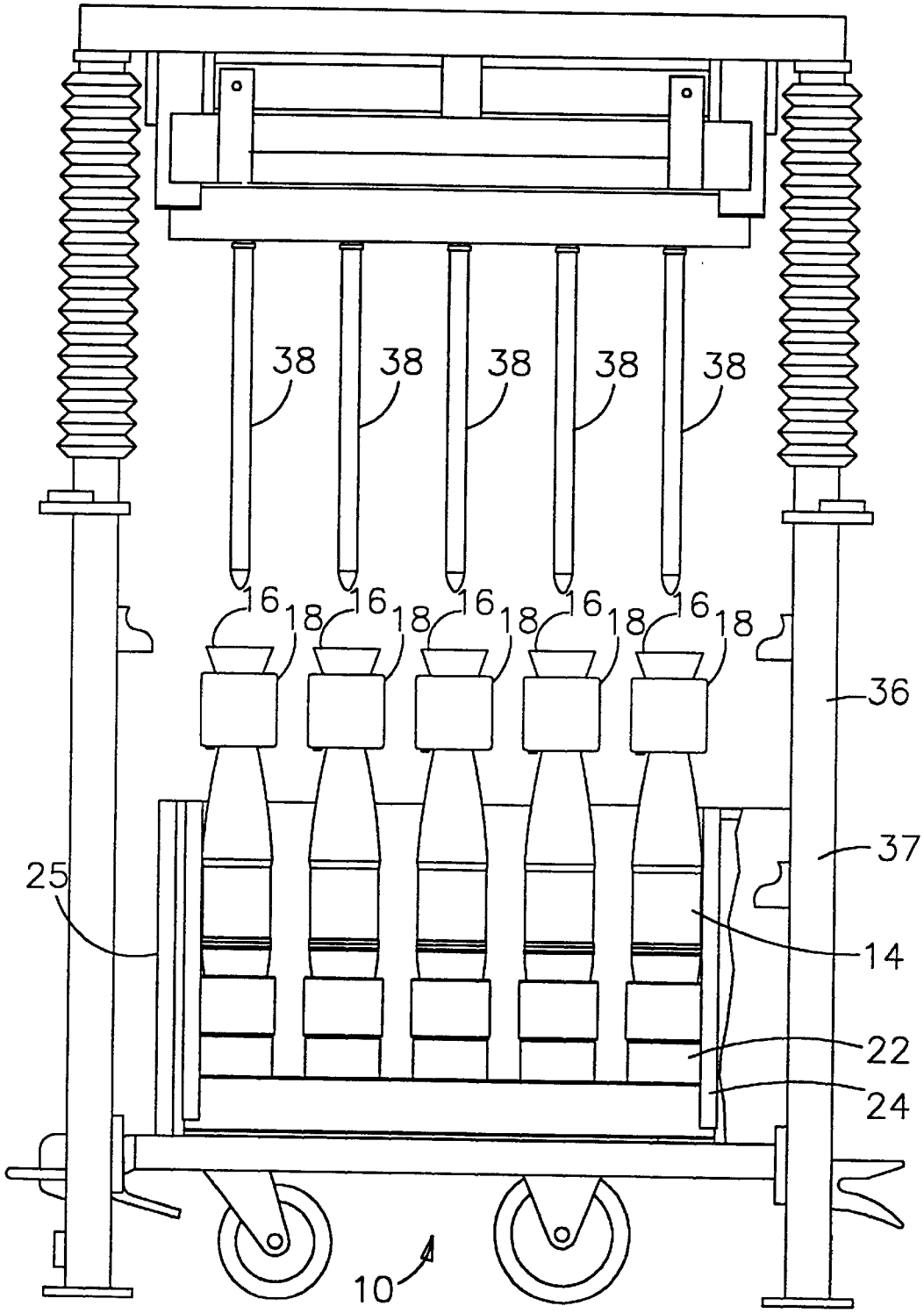
FIG. 2 is a cut-away front view of the cart and bodies from FIG. 1 in place under a heated probe machine.

FIG. 2 shows the cart 10 in a working position beneath a probe machine 36. The probe machine 36 includes uprights 37 that support probes 38. The probes 38 can be selectively heated to a temperature hot enough to melt common explosives that might be used in projectile bodies. The cart 10 is placed in the probe machine 36 such that each of the probes 38 is in alignment with a corresponding funnel 16. The probe machine 36 is adapted such that the probes 38 can be selectively lowered into the funnels 16 and into the necks 30 of the upright projectile bodies 14.

Figure 3:
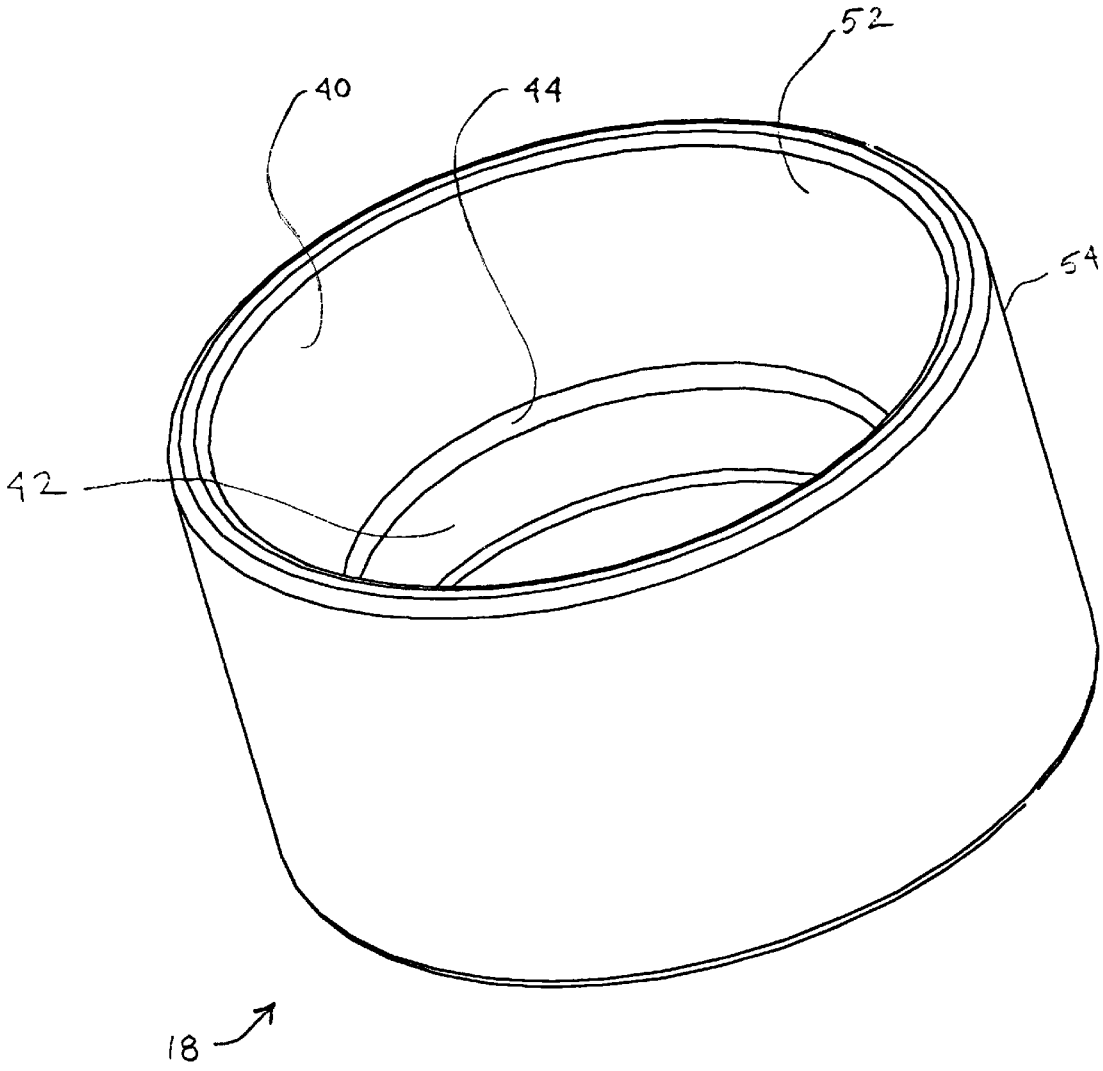
FIG. 3 is a perspective view of a funnel insulator according to the present invention.
Figure 4:
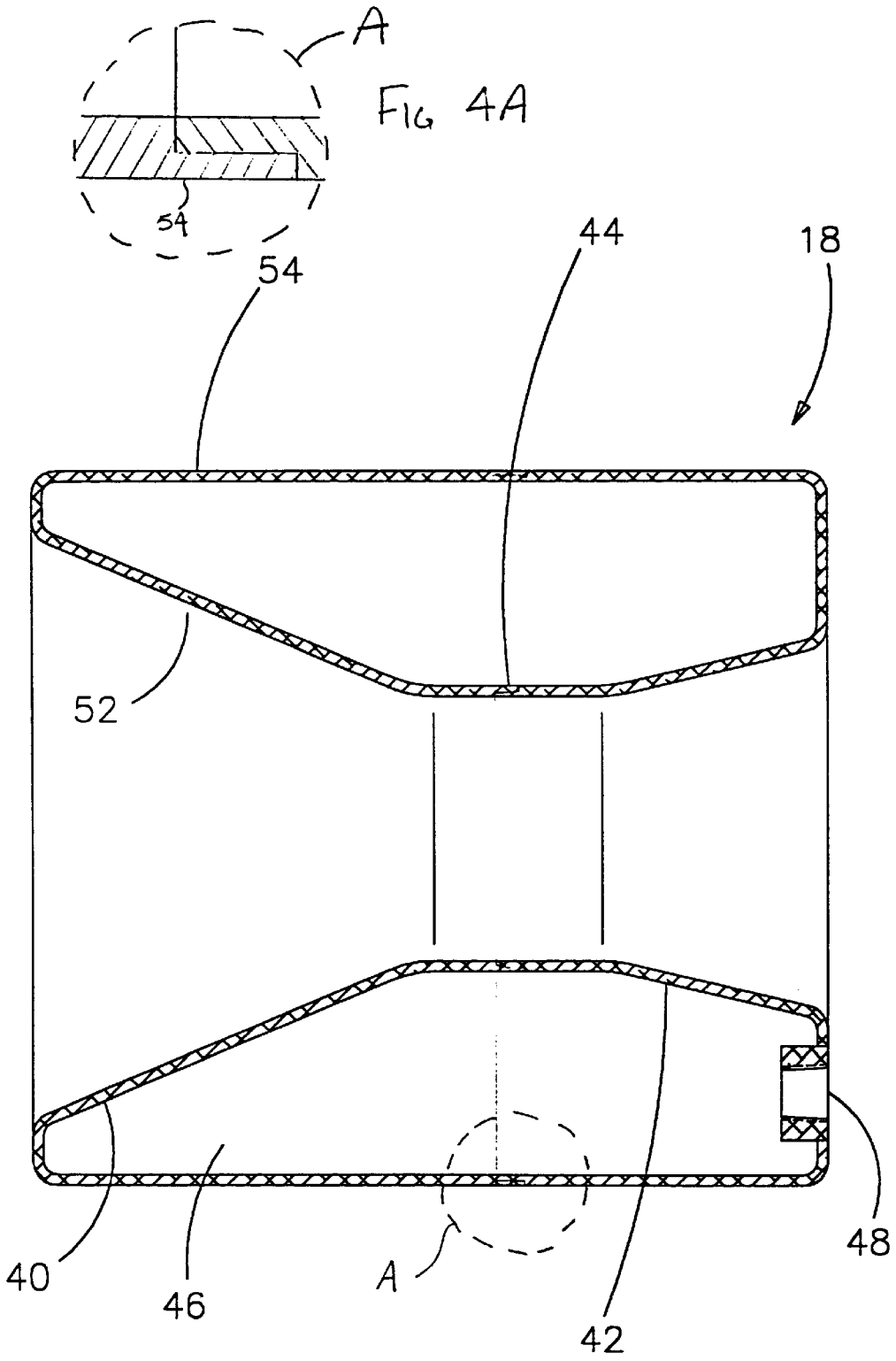
FIG. 4 is a sectional view of the funnel insulator of FIG. 3.

The details of the pre erred funnel insulator 18 are best seen in FIGS. 3 and 4. The funnel insulator 18 is a toroid having a generally planar outer wall 54 in the form of a right rectangular cylinder and a segmented inner wall 52. The inner wall 52 comprises a sloping funnel supporting section 40, a tap red neck engaging section 42, and an intermediate section of 44 that is generally a right rectangular cylinder. The funnel insulator 18 is hollow such that its interior forms a reservoir 46. An orifice 48 is provided through the walls of the funnel insulator 18 such that a phase-change material 56 may be introduced into the reservoir 46. A copy 50 is provided to plug the orifice 48. The funnel insulator 18 can be formed from a variety of materials such as plastic or aluminum. Whatever material is chosen must have a melting point higher than that of the explosive and phase-change material 56 being used.

Figure 5:
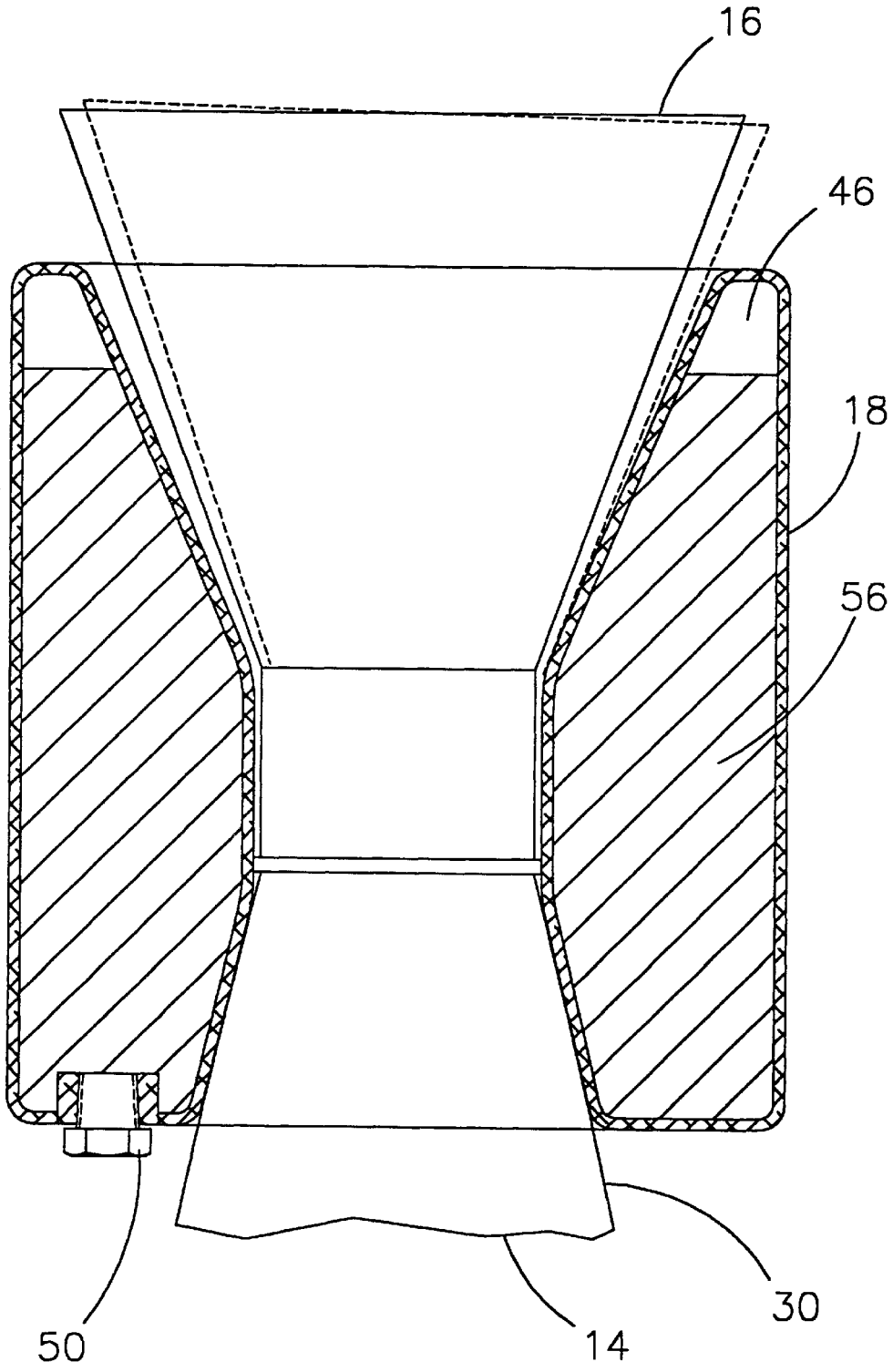
FIG. 5 is partial assembly view showing the insulator of FIG. 3 in place on a projectile body with a funnel resting in the funnel insulator.

FIG. 5 shows a sectional view of a funnel insulator 18 in place on the neck 30 of a projectile body 14. A funnel 16 extends through the funnel insulator 18 into the neck portion 30 of the body 14. The wider mouth portion of the funnel 16 extends above the top of the funnel insulator 18, and the narrow output portion of the funnel 16 extends into the neck 30 of the body 14. The funnel insulator 18 is designed such that its inner wall 52 slopes at a slightly shallower angle then the sides of the funnel 16. This difference in the slopes allows some "play" between the funnel 16 the funnel insulator 18, which can be important when removing the funnel 16 from the hardened projectile.

Figure 6:
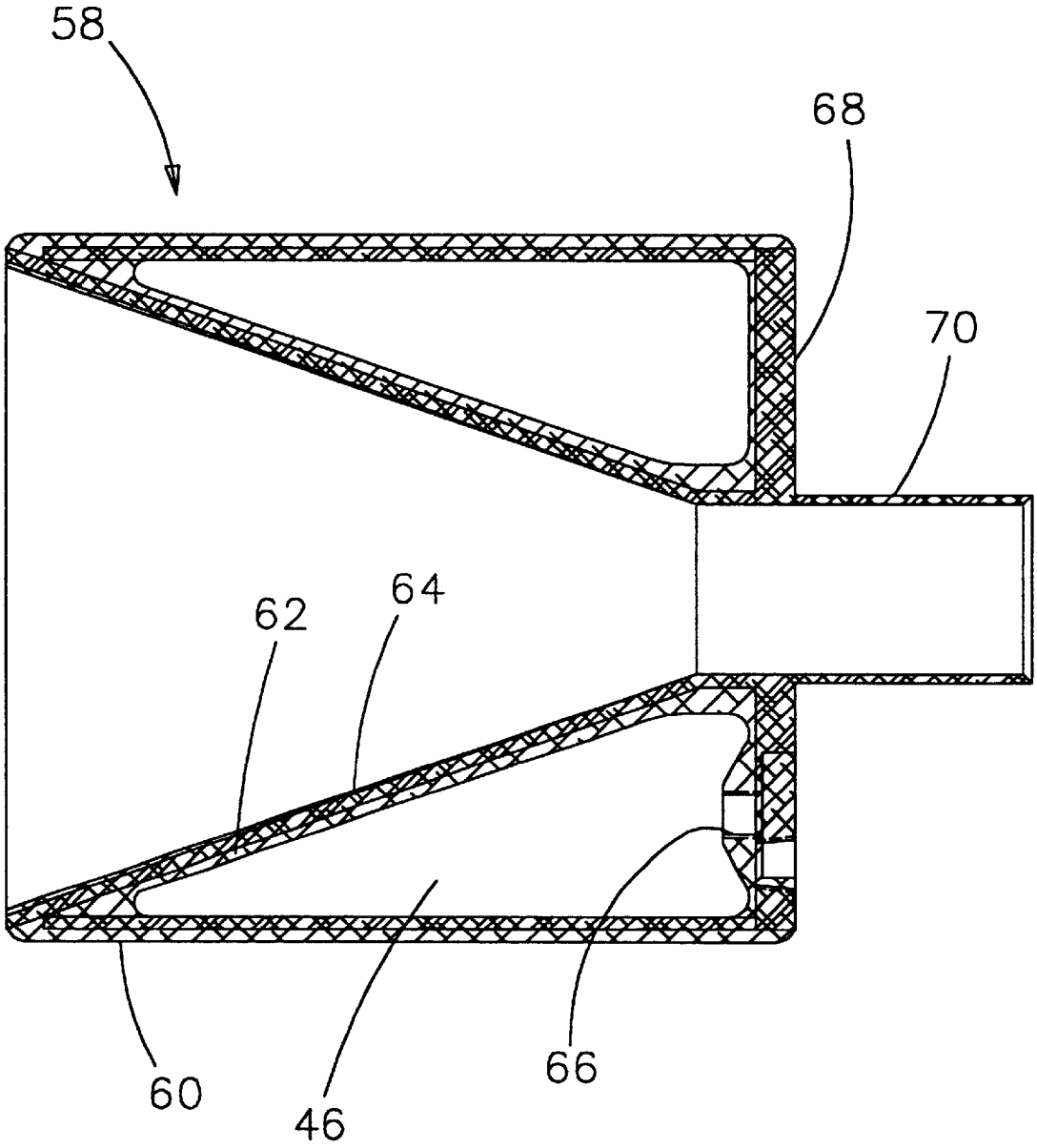
FIG. 6 is a sectional view of an alternative embodiment of an insulated funnel.
Figure 7:
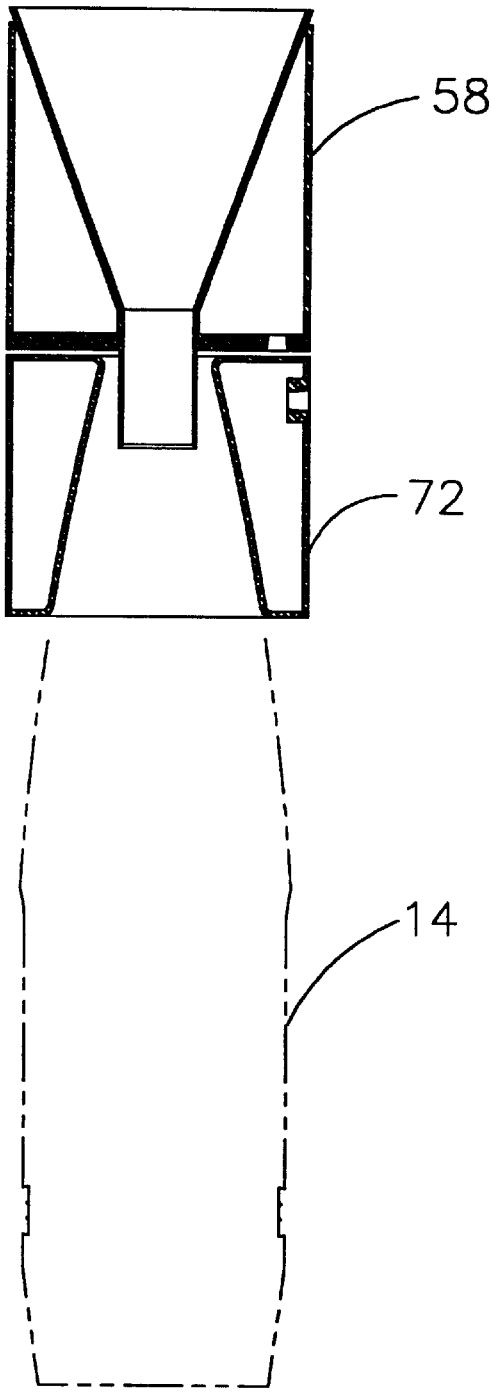
FIG. 7 is a sectional view of an assembly for insulating a funnel and the neck of a projectile body during a casting process.

FIG. 6 shows an insulated funnel 58. The insulated funnel 58 is an alternative to the combination of a funnel insulator 18 and funnel 16. The insulated funnel 58 is a toroid comprising basically an outer wall 60, and inner wall 62, and a bottom wall 68. The walls 60, 62, and 70 enclose a reservoir 46. An orifice 66 is provided through the bottom wall 68 so that a phase-change material 56 may be introduced into the reservoir 46. A lip 70 extends below the bottom wall 68 around the inner radius of the toroid. As seen in FIG. 7, when in use, the bottom wall 68 of the insulated funnel 58 sets on the top of a projectile body 14, and the lip 70 extends into the neck portion 30 of the projectile body 14. The primary advantage of the insulated funnel 58 is that it does not require a separate funnel. The disadvantages of using an insulated funnel 58, as opposed to a combination of a funnel 16 and a funnel insulator 18, are that the surfaces that come in contact with the explosive may be difficult to get completely clean of explosive material. If even a small residue of explosive remains on the insulated funnel 18 during the heating process, it can be dangerous. Furthermore, it can be difficult to construct the insulated funnel 58 so that it can withstand the "knocking" process of removing the insulated funnel from the hardened explosive after the projectiles have cooled.

Figure 8:
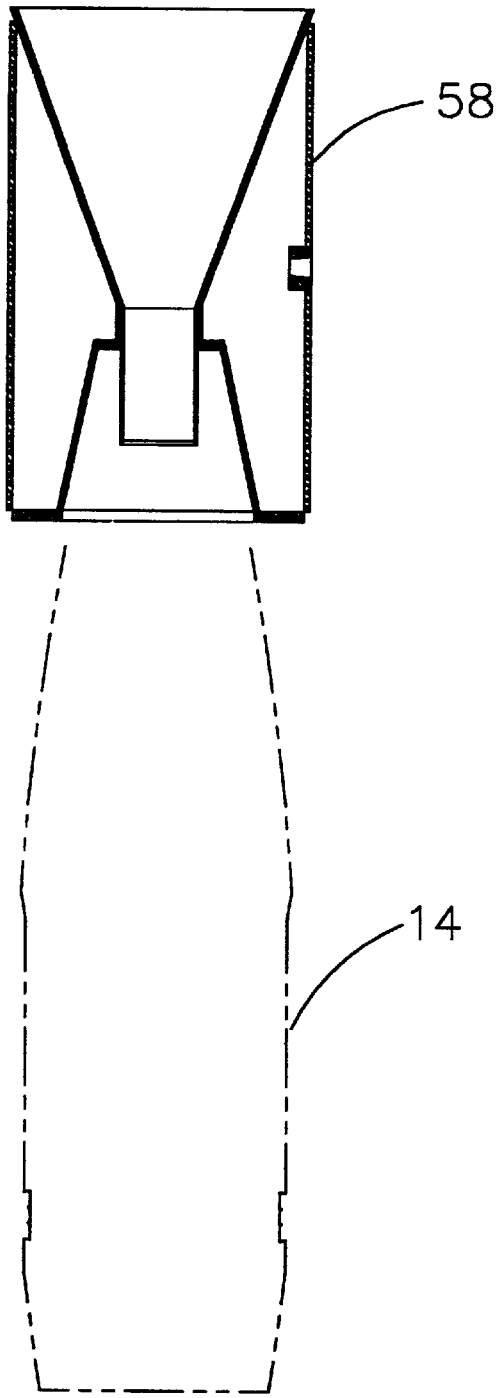
FIG. 8 is a sectional view of alternative embodiment utilizing a single element for insulating a funnel and a neck of a projectile body.

The insulated funnel 58 may be used in conjunction with a separate neck insulator 72, as seen in FIG. 7, or the insulated funnel may be formed as shown in FIG. 8 such that it includes a portion that extends over the neck portion 30 of the projectile body 14. The advantage to the configuration shown in FIG. 7 including separate insulated funnel 58 and neck insulator 72 is that different phase-change materials 56 may be used within the two reservoirs formed in the insulated funnel 58 and the neck insulator 72. It may be desirable to use a phase-change material with a higher melting point in the funnel 16 so that it remains open and flowable even after the neck portion 30 begins to solidify.

Figure 9:
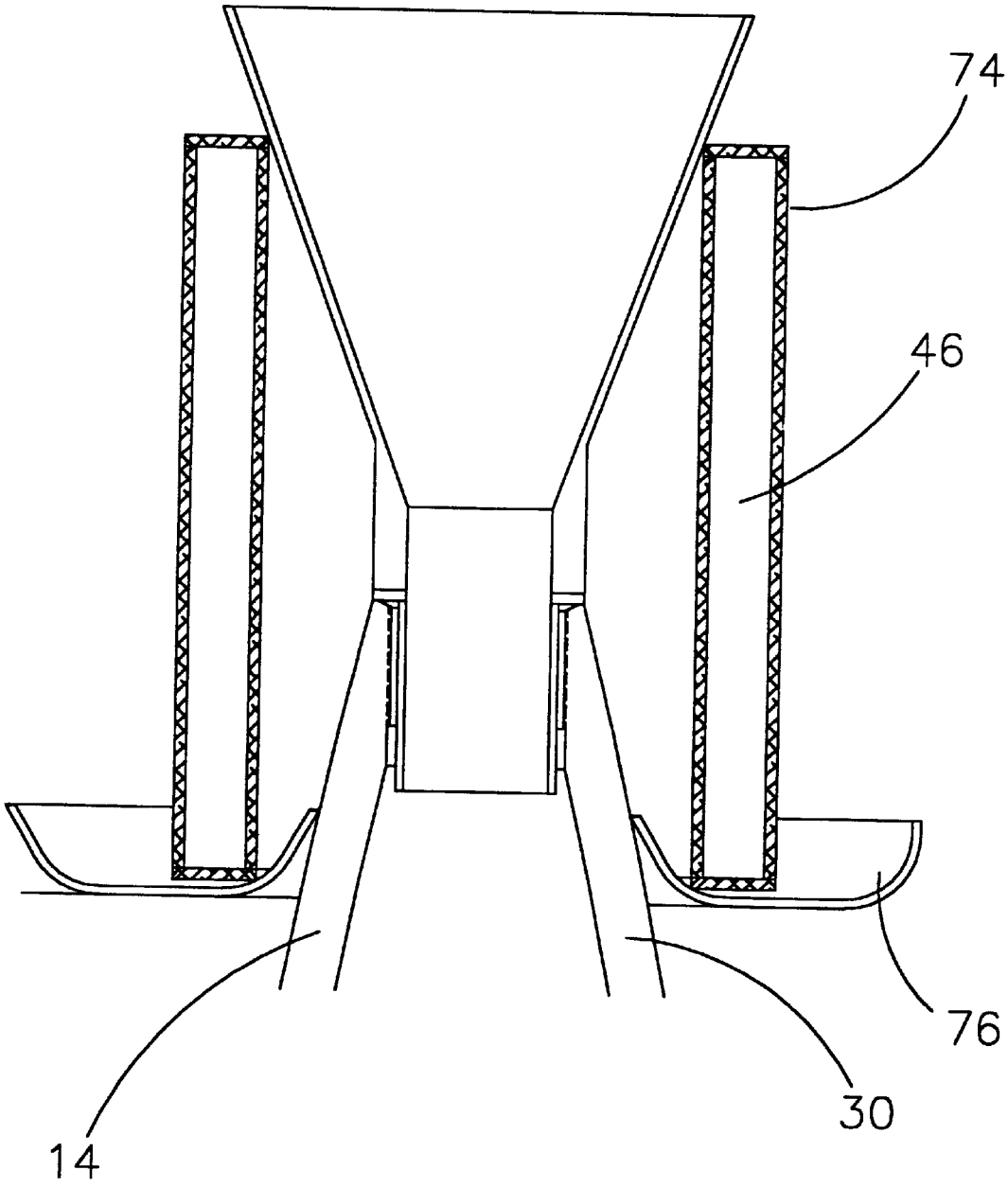
FIG. 9 is an assembly view of an alternative embodiment of a right rectangular phase-change insulator sleeve.

FIG. 9 shows an insulating sleeve 74 that can be placed around the neck 30 of a projectile body 14 and funnel 16 during the loading process. A splash pan 76 is integrated with this design to catch any splashes or spillages of the molten explosive as it being poured into the projectile body 14. The insulating sleeve 74 is formed to include a reservoir 46 for holding a phase-change material 56. The insulating sleeve 74 has the advantage of being relatively easier to manufacture than the insulated funnel 58 or funnel insulator 18, but does not make thermal contact with the funnel surface as efficiently. The splash pan 76 can also be used with the other funnel insulators 18 or insulated funnel 58, to catch any explosive spilled in the loading process.

The preferred phase-change material 56 is wax. Wax of varying melting points may be used depending on what molten material is being cast, and the heat transferred characteristics of the funnel insulator 18 and funnel 16. TNT has a melting temperature of approximately 177.5° Fahrenheit. For TNT, a wax with a melting point of between 208° Fahrenheit and 232° Fahrenheit has been found to be effective. Another common explosive is composition B. Because composition B is poured into projectiles with a high solids content, i.e., sixty percent of RDX in composition B is not molten, it may be desirable to use a phase-change material that has a higher melting point. Those of ordinary skill in the art may be aware of other phase-change materials that will be acceptable. The important criteria for the phase-change material 56 are that its melting point is high enough so that as it changes from a liquid into a solid it will provide enough heat to the funnel 16 and neck 30 for a sufficient time to prevent premature solidifying of the molten explosive in the funnel 16 and neck 30 during the casting process, and that the melting temperature be low enough that the phase-change material 56 does not raise the temperature of the funnel 16 too high.

Thus far the structure and equipment needed to cast explosive projectiles according to the present invention has been discussed. The process for casting such projectiles will now be discussed. The first step is to load the empty projectile bodies 14 onto the rack 22 on the cart 10 in an upright orientation. The bases 34 of the projectile bodies 14 are placed in the rack 22 such that an opening in the neck 30 of each of the projectile bodies 14 is exposed at the top of the projectile body 14. The cart 10 with the loaded projectile bodies 14 is then moved into an oven to preheat the projectile bodies 14 before the casting process. Typically, the projectile bodies 14 are heated to a temperature between 100° Fahrenheit and 165° Fahrenheit. The funnel insulators 18 are also placed into an oven and preheated to a temperature above the melting point of the phase-change material 56. Once the funnel insulators 18 have been heated sufficiently to melt all of the phase-change material 56 within the reservoirs 46, the funnel insulators 18 are removed from the oven and assembled in place on the projectile bodies 14, as best seen in FIG. 1 along with the funnels 16. When assembled in the loading position, the neck engaging section 42 of the funnel insulator 18 rests on the neck 30 of the corresponding projectile body 14. The funnel 16 is then placed inside the funnel insulator 18 such that the sides of the funnel 16 are in contact with the funnel supporting section 40 of the funnel insulator 18. The funnels 16 include a lip that extends from the bottom of the funnel 16 into the opening at the top of the preheated projectile body 14.

The cart 10 loaded with the preheated projectile bodies 14 is then moved into working position under loading machine 12. With the cart 10 in a proper loading position, the funnels 16 are each in alignment with a corresponding spout 26. Optionally, the cart 10 may have a series of loading positions wherein each row of projectile bodies 14 and funnels 16 are placed in alignment with a row of spouts 26. Molten explosive from the manifold 20 can then be poured through spouts 26 into corresponding funnels 16, which funnel the molten explosive into the projectile bodies 14. The projectile bodies 14 are overfilled so that a reserve of molten explosive is contained in the funnels 16. This reserve explosive is necessary to fill the projectile bodies 14 as the explosive solidifies and contracts. Typically TNT will shrink about 13% as it cools and solidifies. The process can be carried out in an environment having a room temperature of between 85° to 125° Fahrenheit. The surface of the funnel 16 is cooled by the air in which it comes in contact with. However, due to the latent heat of fusion, the phase-change material 56 provides a source of heat 56 to the funnel 16 at a constant temperature equal to the melting temperature of the phase-change material. This keeps the surface of the funnel 16 and the neck 30 of the projectile body 14 heated above the melting point of the explosive for a sufficient amount of time, which permits the explosive material in the funnel 16 to flow into the projectile body 14 as the explosive material in the projectile body solidifies and shrinks.

The filled projectile bodies 14 and the funnels 16 and funnel insulators 18 may then be covered with a canvas shroud to further insulate the funnels 16 and projectile neck 30 and to prevent foreign bodies or contaminants from falling into the funnel 16. The cart 10 with the covered projectiles 14 can then be moved to a cooling area. The projectiles 14 are allowed to cool in ambient air for approximately 2–8 hours. Alternatively, a tank may be incorporated with the cart 10 surrounding the projectile bodies 14, filled with water to speed the cooling process. Once the explosive within the funnel 16 solidifies sufficiently to block the opening in the funnel 16 (a process known as "necking off"), the cart 10 is moved into position under the probe machine 36, as seen in FIG. 2. The shroud is removed, and the heated probes 38 are lowered into the neck 30 of the projectiles 14. Preferably the probes are heated to a temperature somewhat above 220° Fahrenheit to melt open the neck area 30 of the projectiles 14. An additional amount of explosive necessary to completely fill the projectile body 14 is then poured into the open funnel 16. The projectiles 14, the funnel insulators 18, and the funnels 16 are then re-covered by a canvas shroud and the cart 10 with the covered projectiles are moved to a cooling area and the projectiles 14 are allowed to cool for an additional 2–5 hours.

The funnels 16 are manually broken away from the projectiles 14, and the funnels 16 and funnel insulators 18 are removed from the projectiles 14. The play between the funnels 16 and the funnel insulators 18 aids the process of breaking the funnels 16 away from the projectiles 14. The threads on the opening of the projectiles 14 are cleaned to remove to any excess explosive material. The projectiles 14 may then be radiographically inspected to check for any defects. The funnels 16 and funnel insulators 18 can then be washed and reused.

The foregoing description of preferred embodiments is meant to be illustrative of the invention, and the invention should not be considered as being limited to the embodiments described herein, except as limited by the following claims. For example, while the process is described in connection with the creation of explosive projectiles, the invention should application to the casting of other products.

What is clawed is:

1. A method of forming a cast article from a casting material that contracts as it solidifies, the method comprising:

providing a mold with an opening:

providing a supply of molten casting material;

placing a funnel in working engagement with said opening in said mold, said funnel having an inner funnel surface for guiding said molten casting material into said mold;

providing a funnel insulator having a reservoir in thermal contact with said inner funnel surface;

wherein said funnel and said funnel insulator are separable pieces, wherein said funnel insulator includes a funnel-shaped surface in thermal contact with said reservoir, said funnel-shaped surface tapering from a relatively wide upper opening at a relatively narrow lower opening, wherein said funnel includes an outer funnel surface that has a slope that is steeper than a slope of said funnel-shaped surface of said funnel insulator such that there is some play between said funnel and said funnel insulator when said funnel is placed in nested engagement with said funnel-shaped surface of said funnel insulator such that said funnel can rock laterally within said funnel-shaped surface;

placing said funnel in nested engagement with said funnel-shaped surface of said funnel insulator prior to pouring said molten material into said mold;

providing a portion of phase-change material within said reservoir;

heating said portion of phase-change material to at least partially melt said portion of phase-change material;

pouring said molten casting material into said mold until said mold is completely filled and an excess amount of molten casting material is retained within said funnel;

allowing said molten casting material within said mold to cool as said phase-change material provides heat to said inner funnel surface while said heated portion of phase-change material at least partially changes from a liquid phase to a solid phase, said heat from said phase change material maintaining said excess amount of molten casting material in said funnel above a melting temperature such that said excess amount of molten casting material within said funnel can feed into said mold as said casting material in said mold solidifies and contracts;

allowing said casting material within said mold to cool and harden into a cast article; and removing said funnel from aid funnel insulator by breaking said funnel away from said cast article after allowing said explosive material within said projectile shell to cool and harden, said play between said funnel and said funnel-shaped surface aiding the process of breaking said funnel away from said cast article.

2. A method of creating explosive projectiles comprising:

providing a projectile shell said projectile shell including an opening at a neck portion of said projectile shell;

providing a portion of explosive material, said explosive material being of the type that contracts as it changes from a molten form to a solid form;

placing said projectile shell on a wheeled cart with said opening facing generally upwardly;

providing a funnel insulator said funnel insulator including a reservoir, said reservoir being at least partially filled with a phase-change material, said funnel insulator further including a generally funnel-shaped surface in thermal contact with said reservoir, said funnel-shaped surface tapering from a relatively wide upper opening at a relatively narrow lower opening;

heating said phase-change material to at least partially melt said phase-change material;

placing said funnel insulator on said neck portion of said projectile shell such that said lower opening in said funnel insulator is in communication with said opening in said projectile shell;

providing a funnel, said funnel having an inner funnel surface for guiding said explosive material into said projectile shell and an outer funnel surface, said outer funnel surface having a slope that is steeper than a slope of said funnel-shaped surface of said funnel insulator said difference in said slopes allowing some play between said funnel and said funnel-shaped surface when said funnel is nested in said funnel-shaped surface such that said funnel can rock laterally within said funnel-shaped surface;

placing said funnel in nested engagement with said funnel-shaped surface of said funnel insulator;

moving said wheeled cart into a loading position such that said inner funnel surface of said funnel is beneath and in alignment with a loading spout;

melting a portion of said explosive material to create a portion of molten explosive material;

pouring said molten explosive material out of said loading spout and across said inner funnel surface into said projectile shell to fill said projectile shell and at least partially fill said funnel;

allowing said molten explosive material to cool within said projectile shell while said heated phase-change material at least partially changes from a liquid phase to a solid phase, said phase-change material providing heat to said inner funnel surface to maintain said molten explosive material within said funnel above a melting temperature of said explosive material and thereby permit said molten explosive material in said funnel to feed into said projectile shell as said molten explosive within said projectile shell solidifies and contracts;

allowing said explosive material within said projectile shell to cool and harden to form an explosive projectile comprising said hardened cooled explosive material and said projectile shell; and removing said funnel from said funnel insulator, said removal of said funnel insulator being aided by said play between said funnel and said funnel insulator.

3. The method according to claim 2, wherein said funnel insulator further comprises a neck engaging portion in thermal contact with said phase-change material reservoir, said neck engaging portion being adapted to engage said neck portion of said projectile shell to maintain said molten explosive within said neck portion of said projectile shell above said melting temperature of said explosive material as said explosive material in other portions of said projectile shell solidifies and contracts.

* * * * *

UNITED STATES PATENT AND TRADEMARK OFFICE

CERTIFICATE OF CORRECTION

PATENT NO. : 6,635,197 B2
APPLICATION NO. : 09/891117
DATED : October 21, 2003
INVENTOR(S) : John David Cortum, Michael Jaye Mathiasmeier and Louis William Stoecker It is certified that error appears in the above-identified patent and that said Letters Patent is hereby corrected as shown below:

On title page item [73] should read,
Assignee is American Ordnance LLC, Middletown, IA (US)

Signed and Sealed this

Third Day of February, 2009

John Doll

JOHN DOLL
*Acting Director of the United States Patent and Trademark Office*